US006837801B1

(12) United States Patent
Souza et al.

(10) Patent No.: US 6,837,801 B1
(45) Date of Patent: Jan. 4, 2005

(54) GOLF PUTTER HEAD WITH INCREASED DIMENSIONS AND INCREASED MOMENT OF INERTIA

(75) Inventors: John C. Souza, Phoenix, AZ (US); Anthony D. Serrano, Peoria, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 10/462,899

(22) Filed: Jun. 16, 2003

(51) Int. Cl.[7] ..... A63B 69/36; A63B 53/04; A63B 53/02

(52) U.S. Cl. ..... 473/251; 473/313; 473/340

(58) Field of Search ..... 473/340, 341, 473/251–256, 327–330, 324, 313; D21/736–746

(56) References Cited

U.S. PATENT DOCUMENTS

| | | | | | |
|---|---|---|---|---|---|
| D58,209 | S | * | 6/1921 | Bacheller | D21/745 |
| D163,083 | S | * | 5/1951 | Belline | D21/745 |
| 2,954,231 | A | * | 9/1960 | MacIntyre | 473/251 |
| D218,178 | S | | 7/1970 | Solheim | |
| D230,869 | S | * | 3/1974 | Winter | D21/745 |
| D234,960 | S | | 4/1975 | Swash | |
| D235,668 | S | | 7/1975 | Swash | |
| D255,373 | S | | 6/1980 | Solheim | |
| 4,444,395 | A | * | 4/1984 | Reiss | 473/335 |
| D282,952 | S | * | 3/1986 | Mattingly | D21/746 |
| 4,815,739 | A | * | 3/1989 | Donica | 473/313 |
| 5,160,141 | A | * | 11/1992 | Crews | 473/313 |
| 5,213,332 | A | * | 5/1993 | Fahy et al. | 473/243 |
| D341,405 | S | | 11/1993 | Solheim | |
| 5,482,281 | A | | 1/1996 | Anderson | |
| D379,484 | S | | 5/1997 | Solheim | |
| 5,630,765 | A | * | 5/1997 | Moore | 473/252 |
| D380,029 | S | | 6/1997 | Anderson | |
| D399,911 | S | | 10/1998 | Nicolette | |
| 5,830,078 | A | * | 11/1998 | McMahan | 473/252 |
| D402,722 | S | * | 12/1998 | Rollinson | D21/742 |
| 5,842,935 | A | | 12/1998 | Nelson | |
| D405,137 | S | | 2/1999 | Nelson | |
| D410,717 | S | | 6/1999 | Anderson | |
| D411,271 | S | | 6/1999 | Nelson | |
| 6,059,669 | A | * | 5/2000 | Pearce | 473/339 |
| 6,080,070 | A | * | 6/2000 | Whitley | 473/340 |
| D449,865 | S | | 10/2001 | Fife | |
| D451,973 | S | | 12/2001 | Wells | |
| 6,350,208 | B1 | * | 2/2002 | Ford | 473/249 |
| D460,990 | S | * | 7/2002 | Jung | D21/736 |

* cited by examiner

*Primary Examiner*—Sebastiano Passaniti
(74) *Attorney, Agent, or Firm*—Darrell F. Marquette

(57) ABSTRACT

A golf putter head includes a face member with a front surface arranged for impacting a golf ball. A rear member extends in an arcuate path of substantially 180 degrees from a heel end of the face member to a toe end of the face member. First and second struts extend from the rear member to the face member and converge toward each other as they approach the face member. A third strut extends from the rear member to the face member and lies between the first and second struts. A V-shaped marking is provided on an upper surface of the face member between the heel and toe ends thereof. One leg of the V-shaped marking is aligned with the first strut and the other leg of the V-shaped marking is aligned with the second strut.

16 Claims, 2 Drawing Sheets

GOLF PUTTER HEAD WITH INCREASED DIMENSIONS AND INCREASED MOMENT OF INERTIA

BACKGROUND OF THE INVENTION

This invention relates generally to golf equipment and, in particular, to a golf putter head with increased dimensions and increased moment of inertia.

Recent developments in golf equipment have resulted in golf putter heads with high moments of inertia. For example, U.S. Pat. No. 5,482,281 to D. W. Anderson discloses a putter head sold under the name DANSER. The Anderson putter head has heel and toe weights mounted on a lower plate-like member. The heel and toe weights and the lower plate-like member are preferably made of heavyweight material such as bronze or steel. An upper shell-like member, preferably made of lightweight material such as plastic or aluminum, is secured to the lower plate-like material to enclose the heel and toe weights. U.S. Pat. No. 5,842,935 to M. J. Nelson discloses a putter head sold under the name NELLI. The Nelson putter head has a horseshoe shaped body formed of high density material such as steel with thickened heel and toe portions. The horseshoe shaped body includes a cavity which receives an insert formed of low density material such as polyurethane. The insert preferably constitutes about 15% of the total weight of the putter head while constituting more than 50% of the total volume of the putter head.

SUMMARY OF THE INVENTION

The present invention provides a golf putter head including a face member having a heel end, a toe end and front surface arranged for impacting a golf ball. The golf putter head also includes a rear member extending in an arcuate path from the heel end to the toe end of the face member, and first and second struts extending from the rear member to the face member and converging toward each other as they approach the face member. A third strut may also be provided in the golf putter head extending from the rear member to the face member and lying between the first and second struts. The first, second and third struts may be aligned to define four triangularly shaped open spaces between the face member and the rear member. The face member has an upper surface with a generally V-shaped marking thereon between the heel and toe ends thereof. The V-shaped marking has one leg aligned with the first strut and another leg aligned with the second strut. Preferably, the first-mentioned leg of the V-shaped marking is aligned with an edge of the first strut, and the other leg of the V-shaped marking is aligned with an edge of the second strut.

DESCRIPTION OF THE PREFERRED EMBODIMENT

Figure 1:
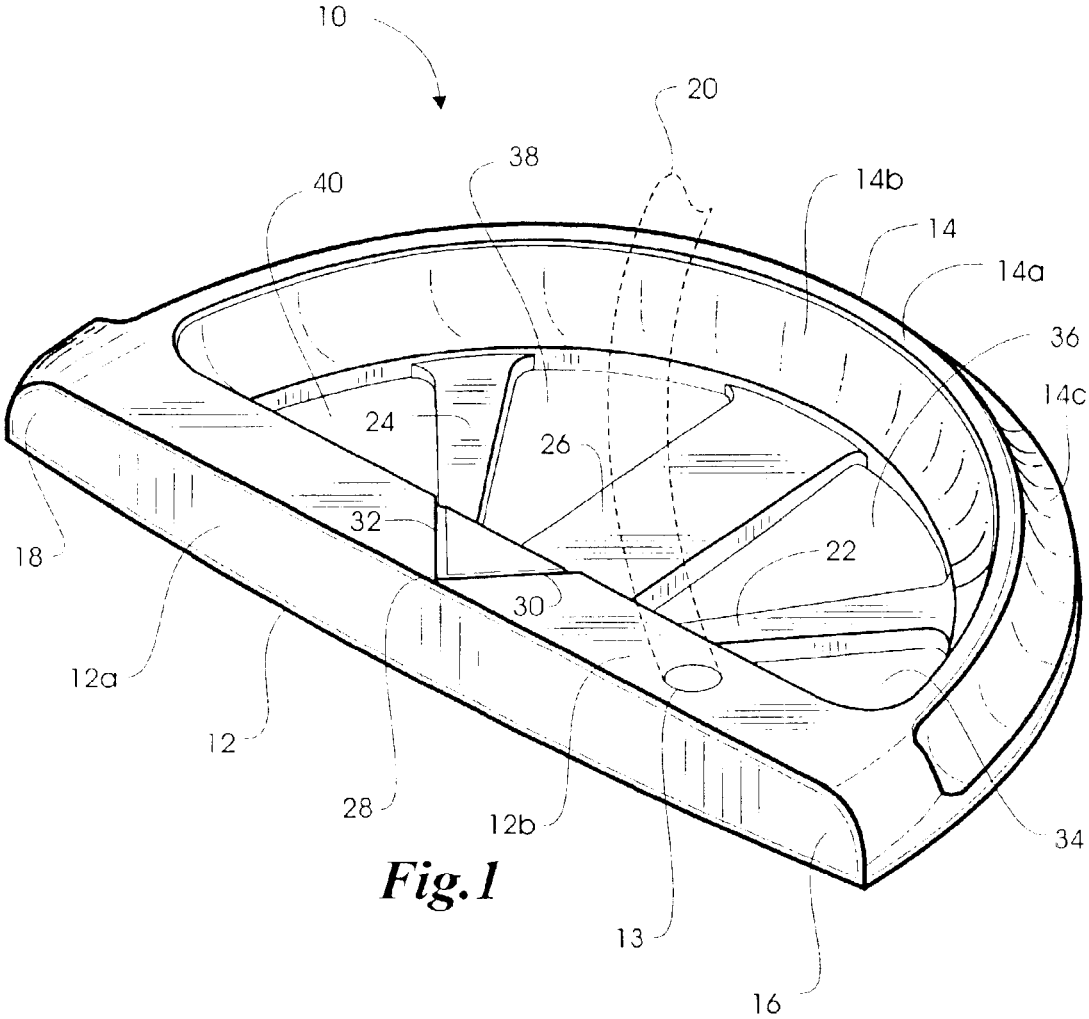
FIG. 1 is a perspective view of a golf putter head according to the preferred embodiment of the present invention.
Figure 2:
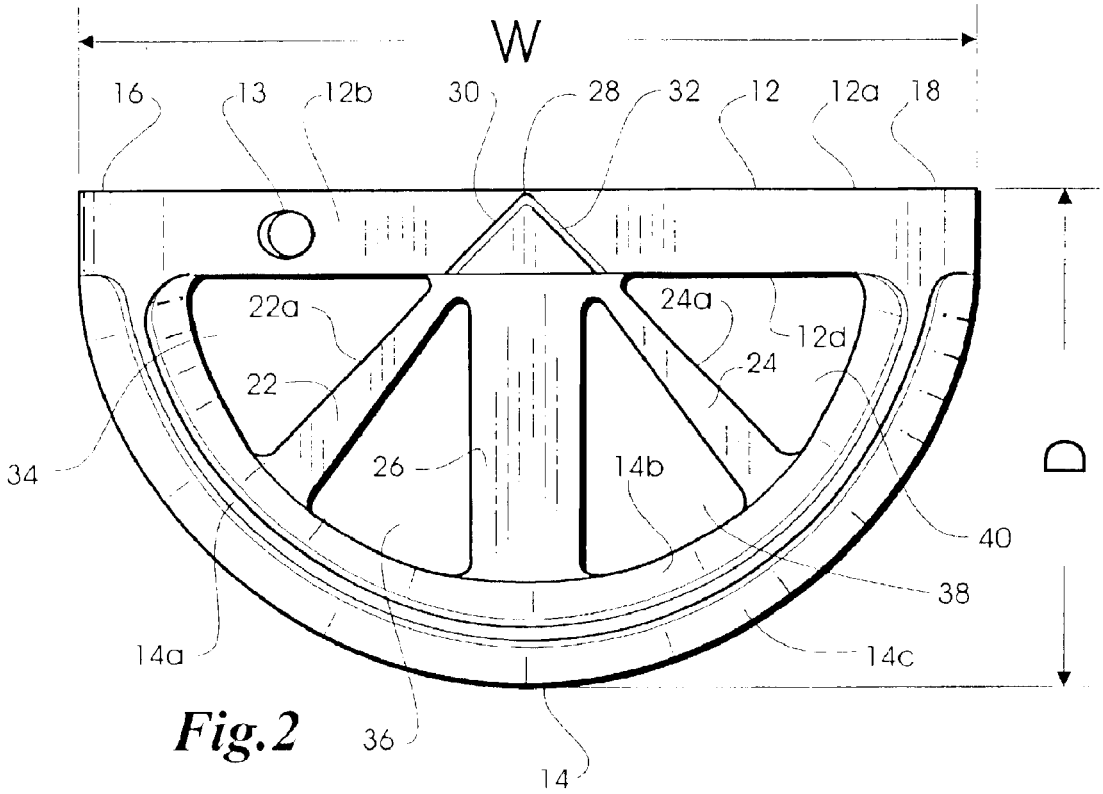
FIG. 2 is a top plan view of the golf putter head shown in FIG. 1.
Figure 3:
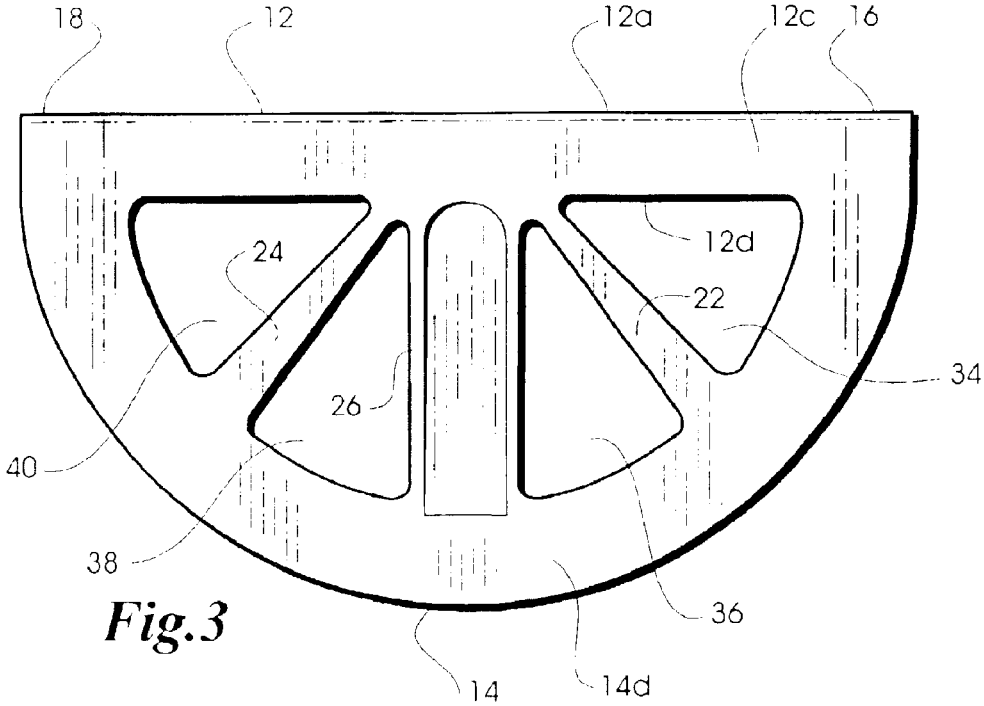
FIG. 3 is a bottom view of the golf putter head shown in FIG. 1.

Referring to FIG. 1, a golf putter head 10 includes a face member 12 and a rear member 14. The rear member 14 extends in an arcuate path of substantially 180 degrees from a heel end 16 of the face member 12 to a toe end 18 of the face member 12. The face member 12 has a front surface 12*a* arranged for impacting a golf ball, an upper surface 12*b* with a hole 13 formed therein for receiving a shaft 20, a lower surface 12*c* located opposite the upper surface 12*b*, and a back surface 12*d* located opposite the front surface 12*a*. The rear member 14 has an upper surface 14*a*, an inner surface 14*b*, an outer surface 14*c* and a lower surface 14*d*. The upper and lower surfaces 14*a*, 14*d* of the rear member 14 are located opposite each other, and the inner and outer surfaces 14*b*, 14*c* of the rear member 14 are located opposite each other.

The golf putter head 10 further includes a first strut 22, a second strut 24 and a third strut 26. The first and second struts 22, 24 extend from the rear member 14 to the face member 12 and converge toward each other as they approach the face member 12. A generally V-shaped marking 28 is provided on the upper surface 12*b* of the face member 12 between the heel and toe ends 16, 18. The V-shaped marking 28 has one leg 30 thereof aligned with an edge 22*a* of the first strut 22 and another leg 32 thereof aligned with an edge 24*a* of the second strut 24. The third strut 26 also extends from the rear member 14 to the face member 12 and lies between the first and second struts 22, 24.

It will be understood that the putter head 10 is preferably made of lightweight material such as aluminum or titanium so that it will have increased dimensions. For example, the putter head 10 may have a width W of between 4.0 and 12.0 inches, preferably 9.0 inches, measured between the heel end 12*a* and the toe end 12*b* of the face member 12. Also, the putter head 10 may have a depth D of between 2.0 and 6.0 inches, preferably 4.5 inches, measured between the front surface 12*a* of the face member 12 and the outer surface 14*a* of the rear member 14. These dimensions for the width W and depth D provide the putter head 10 with an increased moment of inertia.

The first, second and third struts 22, 24 and 26 are connected to the back surface 12*d* of the face member 12 and to the inner surface 14*b* of the rear member 14 and are arranged to define four triangularly shaped open spaces 34, 36, 38 and 40 between the face member 12 and the rear member 14. Open spaces 34 and 40 are of identical size while open spaces 36 and 38 are of identical size. The open spaces 34, 36, 38 and 40 allow the putter head 10 to have the increased dimensions described above without exceeding a desired weight of approximately 350 to 500 grams.

What is claimed is:

1. A golf putter head comprising:

a face member having a heel end, a toe end and a front surface arranged for impacting a golf ball;

a rear member extending in an arcuate path from the heel end to the toe end of said face member;

first and second struts extending between and connected to said rear member and said face member, said first and second struts converging toward each other as they approach said face member; and said first and second struts being arranged to define open spaces between said face member and said rear member, said open spaces not being closed off be a bottom member thereby providing the putter head with increased width and depth dimensions.

2. The golf putter head of claim 1, further comprising a third strut extending between and connected to said rear member and said face member, said third strut lying between said first and second struts.

3. The golf putter head of claim 2, wherein said first, second and third struts are arranged to define four triangularly shaped open spaces between said fare member and said rear member.

4. The golf putter head of claim 1, wherein said arcuate path extends substantially 180 degrees.

5. The golf putter head of claim 1, wherein said face member, said rear member and said struts are made of aluminum.

6. The golf putter head of claim 1, wherein said face member, said rear member and said struts are made of titanium.

7. The golf putter head of claim 1, wherein said putter head has a width between 4.0 and 12.0 inches measured between said heel and toe ends of said face member.

8. The golf putter head of claim 7, wherein said putter head has a width of 9.0 inches measured between said heel and toe ends of said face member.

9. The golf putter head of claim 1, wherein said putter head has a depth between 2.0 and 6.0 inches measured between the front surface of said face member and an outer surface of said rear member.

10. The golf putter head of claim 1, wherein said putter head has a depth of 4.5 inches measured between the front surface of said face member and an outer surface of said rear member.

11. The golf putter head of claim 1, wherein said putter head has a desired weight of approximately 350 to 500 grams.

12. The golf putter head of claim 1, wherein said first and second struts taper in width as they extend from said rear member to said face member.

13. The golf putter head of claim 1, wherein said face member has a height dimension, and wherein said first and second struts each have a height dimension that is substantially less than the height dimension of said face member.

14. The golf putter head of claim 13, wherein said rear member has a height dimension that is substantially equal to the height dimension of said face member.

15. A golf putter head comprising:

a face member having a heel end, a toe end and a front surface arranged for impacting a golf ball;

a rear member extending in an arcuate path from the heel end to the toe end of said face member;

first and second struts extending between and connected to said rear member and said face member, said first and second struts converging toward each other as they approach said face member; and said face member having an upper surface with a generally V-shaped marking thereon between the heel and toe ends, said V-shaped marking having one leg aligned with said first strut and another leg aligned with said second strut.

16. The golf putter head of claim 15, wherein said one leg of said V-shaped marking is aligned with an edge of said first strut, and wherein said another leg of said V-shaped marking is aligned with an edge of said second struts.

* * * * *